United States Patent [19]

Osborne, Jr.

[11] Patent Number: 4,930,466

[45] Date of Patent: Jun. 5, 1990

[54] IGNITION SYSTEM FOR INTERNAL COMBUSTION ENGINES

[76] Inventor: Paul N. Osborne, Jr., 837 Orange, Redlands, Calif. 92373

[21] Appl. No.: 367,799

[22] Filed: Jun. 19, 1989

[51] Int. Cl.[5] ..... F02P 11/02

[52] U.S. Cl. ..... 123/179 BG; 123/41.15; 123/196 S; 123/630

[58] Field of Search ..... 123/179 BG, 630, 198 DC, 123/198 D, 41.15, 196 S

[56] References Cited

U.S. PATENT DOCUMENTS

| | | | |
|---|---|---|---|
| 1,449,026 | 3/1923 | Wolfe . | |
| 2,222,542 | 11/1940 | Robison | 123/196 |
| 3,362,388 | 1/1968 | Lindberg et al. | 123/630 |
| 4,102,316 | 7/1978 | Valbert | 123/198 DB |
| 4,147,151 | 4/1979 | Wright | 123/198 DC |
| 4,369,745 | 1/1983 | Howard | 123/198 DC |
| 4,429,670 | 2/1984 | Ulanet | 123/198 D |
| 4,449,495 | 5/1984 | Fiala | 123/198 DB |
| 4,485,772 | 12/1984 | Uchida et al. | 123/179 B |
| 4,531,500 | 7/1985 | Burson | 123/630 |
| 4,574,752 | 3/1986 | Reichert, Jr. et al. | 123/198 DB |
| 4,648,364 | 3/1987 | Wills | 123/198 D |
| 4,672,941 | 6/1987 | Yamagata | 123/602 |

*Primary Examiner*—Andrew M. Dolinar
*Attorney, Agent, or Firm*—Harvey S. Hertz

[57] ABSTRACT

An ignition system for a fuel burning engine is provided connected to and from a battery, a coil, and a starter motor. A protection circuit having pressure and temperature sensing switches has relay contacts in series with the coil. The relay contacts open when abnormal running temperatures and pressures occur to shut down the engine. During startup, a battery voltage is supplied to the coil through a conventional key operated switch and in response to the energization of the starter solenoid. The latter makes possible the elimination of an undesirable prior art bypass switch.

2 Claims, 1 Drawing Sheet

FIG. 1
PRIOR ART
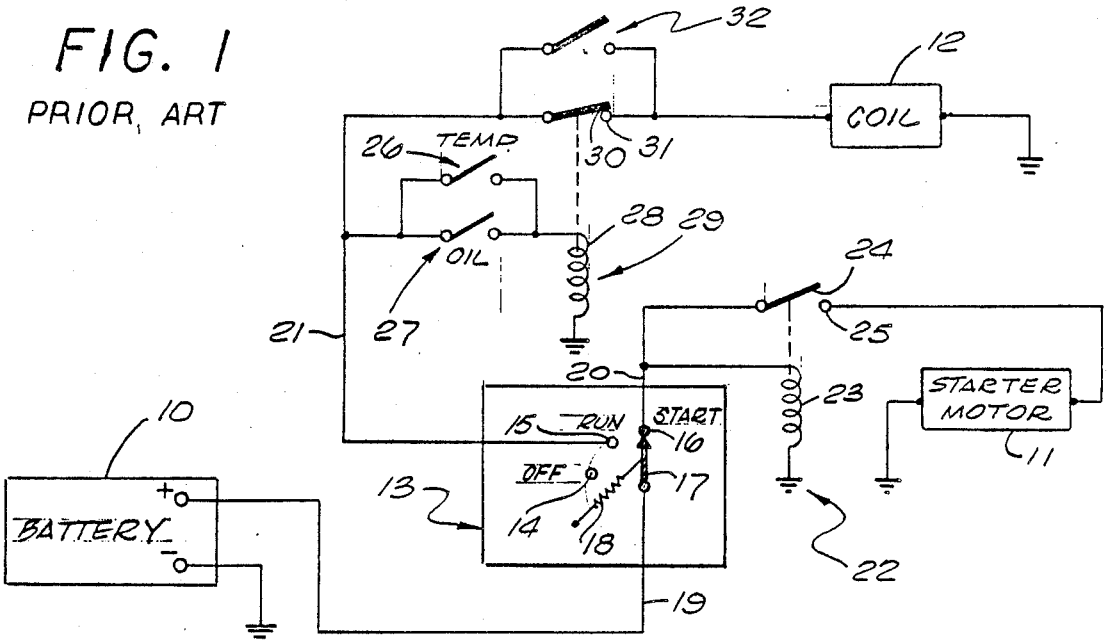
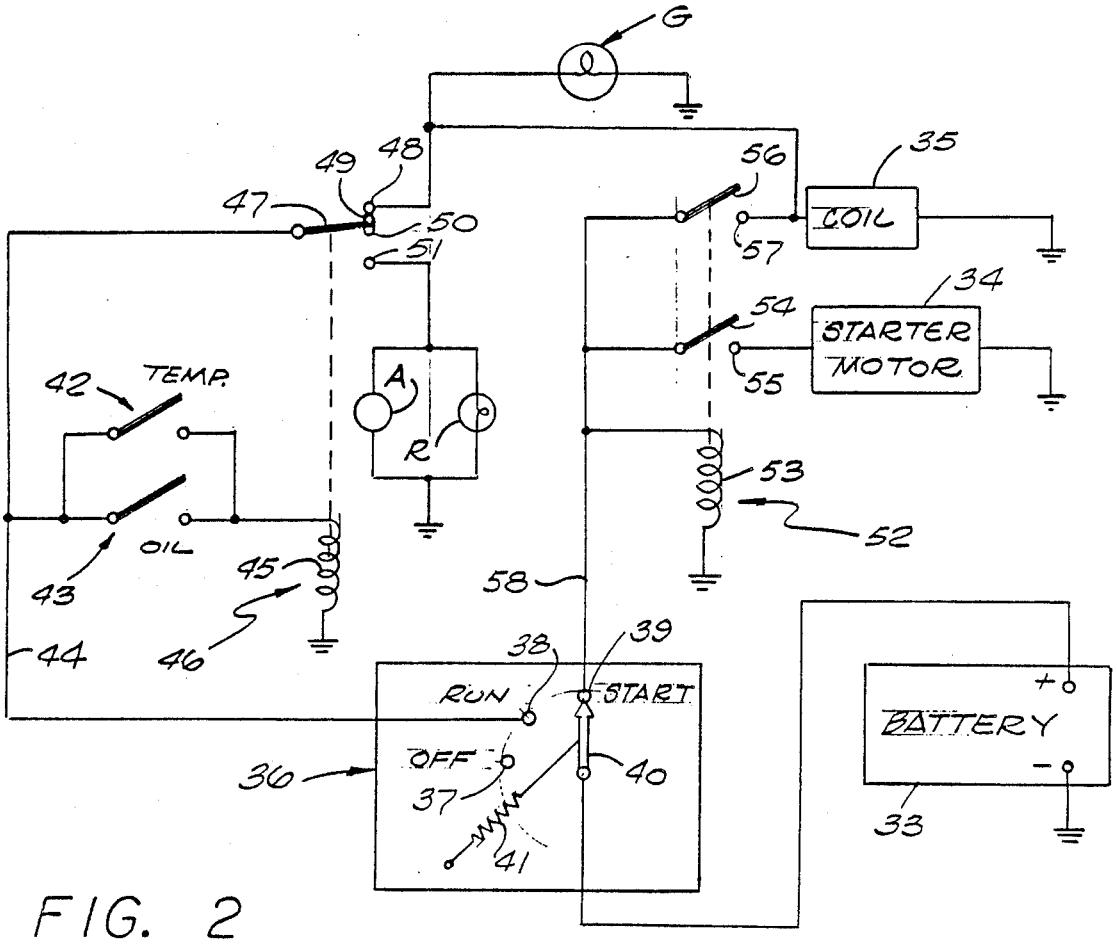
FIG. 2

IGNITION SYSTEM FOR INTERNAL COMBUSTION ENGINES

BACKGROUND OF THE INVENTION

1. Field of the Invention

This invention relates to gear for initially placing an internal combustion engine in a starting mode of operation, and subsequently placing the engine in a running mode of operation, and more particularly to gear for doing so with a minimum amount of equipment and with a minimum amount of manual effort.

2. Background Art

It is conventional to employ an ignition switch which has off, start and run positions. Starting is accomplished by turning the ignition switch from the off position, through the run position, to the start position. In the start position, the starter motor is turned on. In the run position, the coil is connected from the battery through an ignition switch run contact and a pair of normally closed contacts of a protective relay. The protective relay opens its normally closed contacts to disconnect the coil from the battery in the event of low oil pressure, overtemperature and/or other critical conditions. In this prior art system, it is, however, necessary to provide a momentary contact bypass switch in parallel with the normally closed contacts of the protective relay. The bypass switch is spring loaded open. It is a mechanical switch which must be operated manually while the ignition switch is turned to the start position.

The use of the bypass switch also has another substantial disadvantage. The operator may close the bypass switch and the ignition switch when the engine temperature is too high or oil pressure too low, overriding the sensing switches. The engine may then continue to run and become seriously damaged. Piston heads may in fact melt down in some cases.

Certain prior art patents have come to applicant's attention. Partial descriptions of each of these patents follow hereinafter.

U.S. Pat. No. 1,449,026 to M. P. Wolfe

Claim 1 of this patent discloses, inter alia, the combination of a fuel pump and a heat-responsive stopping device adapted to stop the fuel pump.

U.S. Pat. No. 2,222,542 to W. M. Robison

This patent discloses (page 1, column 1, lines 1 through 8) a mechanism for suspending operation of an ignition system at a predetermined speed of an engine when its oil supply has been substantially exhausted.

U.S. Pat. No. 4,102,316 to G. G. Valbert

This patent (Abstract, lines 3 through 6) discloses "While the engine is idling, shutdown is initiated by fuel cutoff when engine oil pressure is below a predetermined level."

U.S. Pat. No. 4,369,745 to W. A. Howard

This patent discloses (Abstract, lines 1 through 4) "A safety interlock for a vehicle drive through a transmission by an internal combustion engine that has a magneto ignition system and a seat occupied by a driver."

U.S. Pat. No. 4,429,670 to G. D. Ulanet

This patent discloses (Abstract, lines 1 through 5) "Internal combustion engine protection systems including visual and audible signals responsive to operative conditions of at least coolant level, engine temperatures, high and low oil pressures and, in the case of turbochargers, to air intake pressures."

U.S. Pat. No. 4,449,495 to E. Fiala

This patent discloses (Abstract, lines 1 through 4) "A vehicle is equipped with an engine, a transmission and a control device for cutting off the engine. This control device is actuated as a function of the position of the gearshift lever."

U.S. Pat. No. 4,485,772 to S. Uchida et al.

This patent discloses, in part, a control circuit including deenergizing means responsive to one of two conditions for disabling indicator means.

U.S. Pat. No., 4,531,500 to B. 0. Burson

This patent discloses a breakerless ignition system. A "kill" switch 24 is provided to shut off an engine. The "kill" switch 24 is normally open. It provides a shunt.

U.S. Pat. No. 4,574,752 to M. E. Reichert, Jr. et al.

This patent discloses a "bypass switch" (column 4, line 64) and a conventional "kill switch" (column 1, line 28).

U.S. Pat. No. 4,648,364 to W. H. Wills

This patent discloses automatic apparatus for use in engine warmup and cool down responsive to ambient temperature (Abstract).

U.S. Pat. No. 4,672,941 to T. Yamagata

This patent discloses a transformer coupled circuit for developing a spark at a spark plug.

SUMMARY OF THE INVENTION

The system of the present invention overcomes the disadvantages of the prior art and other disadvantages disclosed herein by providing new ways to bypass the normally closed contacts of a protective relay. One way in which the same may be accomplished is via the start contact of a conventional key-operated ignition switch through an additional pair of normally open contacts of the start solenoid. The starter solenoid may also have another pair of contacts to connect the ignition switch start contact to the starter motor. The start and run contacts of the ignition switch receive a connection from the battery through an ignition switch, key-operated pole. The ignition switch pole is spring biased to move from the start contact to the run contact. The off contact of the ignition switch is positioned on the side of the run contact opposite the position of the start contact relative to the run contact.

Alternatively, the said additional (bypass) contacts of the starter solenoid of FIG. 1 may be omitted and the coil connected directly from the winding of the starter solenoid or the starter motor.

A lamp and an audible alarm may be connected to show energization of the protective relay winding. A lamp may also be provided to monitor the voltage across the spark coil.

In one embodiment of the system of the present invention, temperature and oil switches are connected in parallel to energize the protective relay winding by a series connection of this parallel circuit to the relay winding. The temperature and oil switches are normally open and close on the occurence of a hazardous condition.

It will be seen that the present invention has substantial advantages over the prior art. The bypass switch is eliminated according to the invention. Thus manual operation thereof and manual override of the temperature and other sensitive switches is prevented. Serious concomitant damage to the engine is thus also prevented. Yet the engine will start without a manually operable bypass switch.

BRIEF DESCRIPTION OF THE DRAWINGS

FIG. 1 is a schematic diagram of a prior art ignition system for an internal combustion engine.

FIG. 2 is a schematic diagram of the ignition system of the present invention which may be employed in lieu of the prior art system shown in FIG. 1.

DETAILED DESCRIPTION OF THE PRIOR ART EMBODIMENT

In FIG. 1 certain parts employed in connection with a conventional internal combustion engine are shown. One is a battery 10. Another is a starter motor 11. A third is a coil 12. A pair of points and a "condenser" (capacitor) are connected to coil 12 in the conventional way. These points and condenser are thus not shown.

An ignition switch is provided at 13 having off, run and start contacts 14, 15 and 16, respectively. Ignition switch 13 also has a rotatable pole 17 engagable with the contacts 14, 15 and 16. Pole 17 engages run contact 15 before it disengages start contact 16. A spring 18 biases pole 17 toward run contact 15. Pole 17 must be held manually while in engagement with start contact 16; however, pole 17 will stay stationary in its run position. Moves to and from the off position with pole 17 in engagement with off contact 14 can be made only manually.

Ignition switch 13 has an input lead 19 connected from battery 10 to pole 17, and first and second output leads 20 and 21, respectively, connected from start and run contacts 16 and 15, respectively.

A starter solenoid is provided at 22 having a winding 23 and normally open contacts 24 and 25. Winding 23 is connected from lead 20. Contact 24 is also connected from lead 20. Contact 25 is connected to starter motor 11.

Temperature sensitive and oil sensitive switches are provided at 26 and 27, respectively, and are connected in parallel. This parallel connection is, in turn, connected from lead 21 to the winding 28 of a protective relay 29 having normally closed contacts 30 and 31.

Temperature switch 26 is normally open and closes when engine temperature is above a hazardous (high) value.

Oil switch 27 is normally closed, but when oil pressure rises from zero to normal, oil switch 27 opens.

A conventional, manually operable, normally open bypass switch 32 is connected in parallel with relay contacts 30 and 31. Switch 32 is spring biased open as is conventional. Relay contact 30 is connected from lead 21. Contact 31 is connected to coil 12.

OPERATION OF THE PRIOR ART EMBODIMENT OF FIG. 1

Before starting, pole 17 of ignition switch 13 will be found in engagement with off contact 14. Pole 1 will then be manually turned to a position in engagement with start contact 16 (briefly engaging run contact 15). Nothing happens on engagement of pole 17 with run contact 15 because oil switch 27 is closed. Relay winding 28 is thus energized and relay contacts 30 and 31 open. Coil 12 is then not connected from battery 10 until bypass switch 32 is closed. Switch 32 thus, when closed, by-passes (shunts) the open contacts 30 and 31. If pole 17 is turned to start contact 16, starter solenoid 22 will apply the voltage of battery 10 to starter motor 11 through its normally open contacts 24 and 25. If this is done while switch 32 is closed, oil pressure will rise, oil switch 27 will open, relay winding 28 will deenergize, and contacts 30 and 31 will close. The need for closure of switch 32 is thereafter obviated. If the engine keeps running, pole 17 may be moved to run contact 15 and thereafter, switch 32 may be opened.

Oil switch 27 will remain open as long as oil pressure remains normal.

In the event of overtemperature or underpressure corresponding switch 26 and/or switch 27 will close. Relay winding 28 will then energize and contacts 30 and 31 will open. Switch 32 will already be open. Thus coil 12 will be denied the battery voltage. The engine will then die. To turn the engine off, pole 17 is put into engagement with off contact 14.

Note that switch 32 is necessary and manually operable because contacts 30 and 31 must be shunted during starting. The existence of manually operable switch 32 makes it possible for an operator to seriously damage an engine by mistake as explained previously.

DESCRIPTION OF THE PREFERRED EMBODIMENT OF THE PRESENT INVENTION

In FIG. 2 a battery 33, a starter motor 34 and a coil 35 are shown. Battery 33, starter motor 34 and coil 35 may all be conventional and as described herein.

An ignition switch 36 shown in FIG. 2 may be conventional and operate in the same way (except as described herein) as ignition switch 13 shown in FIG. 1. Thus ignition switch 36 has off, run and start contacts 37, 38 and 39, respectively, a pole 40 and a spring 41.

Temperature and oil switches are provided at 42 and 43, respectively. Switches 42 and 43 are connected in parallel from a lead 44, in turn, connected from run contact 38. Switches 42 and 43 are connected from lead 44 to the winding 45 of a protective relay 46 having a pole 47, normally closed contacts 48 and 49, and normally open contacts 50 and 51. The moveable contacts 49 and 50 are connected from lead 44 via pole 47.

An audible alarm A and a red lamp R are connected from contact 51. A green lamp G is connected from contact 48 and coil 35.

A starter solenoid is provided at 52 having a winding 53, at least a first pair of normally open contacts 54 and 55, and, a second pair of normally open contacts 56 and 57. The contacts 54 and 56 and solenoid winding 53 are connected from a lead 58 which, in turn, is connected to start contact 39.

Contacts 55 and 57 are, respectively, connected to starter motor 34 and coil 35.

OPERATION OF THE IGNITION SYSTEM OF THE PRESENT INVENTION

Starting pole 40 from engagement with off contact 37, passing run contact 38, coil 35 will receive no battery voltage because relay 46 will be energized via switch 43 (zero pressure) and contacts 48 and 47 will be open. Note there is no bypass switch 32 in FIG. 2. However, when pole 40 engages the start contact 39, battery voltage is supplied to solenoid winding 53 as well as contacts 54 and 56. When starter solenoid 52 is energized, contacts 54 and 55 make, and contacts 56 and 57 make. The battery voltage is thus supplied to starter motor 34 and to coil 35.

As before, movement of pole 40 to its run position will permit the engine to run. The oil pressure will rise during starting and neither of the temperature or oil switches 42 or 43, respectively, will be closed. Relay winding 45 will be deenergized, and coil 35 will receive the battery voltage from run contact 38 through (now) closed contacts 48 and 49.

Closure of either one or both of the switches 42 and 43 will cause the engine to die by opening contacts 48 and 49 in series with coil 35.

Turning pole 40 to the off position will also remove the battery voltage from coil 35 and permit the engine to die.

Preferably ignition switch 36 is of the conventional rotatable key-operated (security) type except as noted.

The present invention may be used with any one of the many conventional internal combustion engines.

Note will be taken that, in accordance with the ignition system of the present invention, only switch 36 need be employed and switch 32, which must be manually operated, is omitted.

Other alternatives have been previously discussed.

In any case, the manual override of the prior art temperature et al. protection circuits by the operator s manual use of the bypass switch 32 and the sometimes serious damage caused thereby is prevented by the use of the present invention omitting switch 32.

Note especially that solenoid contacts 56 and 57, when they make, maintain the battery voltage across coil 35 during the starting time required for oil switch 43 to open.

What is claimed is:

1. In an ignition system for an internal combustion engine, said ignition system including a battery , a spark coil and a starter motor, the combination comprising: an ignition switch having an off contact, a run contact and start contact, said ignition switch having a pole for engagement with said off, start and run contacts in that order, said ignition switch pole being spring biased from said start contact to said run contact, said ignition switch pole being connected from said battery; a starter solenoid having first and second pairs of contacts, said first pair of solenoid contacts being connected from said ignition switch start contact to said starter motor, said second pair of solenoid contacts being connected from said ignition switch start contact to said spark coil; a protective relay having a winding and at least a first pair of contacts, said relay first pair of contacts being normally closed and being connected in series from said run contact to said spark coil; a temperature switch adapted to close on an increase in temperature to a dangerous level; and an oil switch adapted to close when the oil pressure falls to a dangerous level, said temperature and oil switches being connected in parallel with each other, said parallel connection of said temperature and oil switches being connected in series in between said run contact and said relay winding, whereby said second pair of contacts of said starter solenoid maintain a battery voltage across said coil during the starting time required for said oil switch to open.

2. The invention as defined in claim 1, wherein a green lamp is connected in parallel with said spark coil, said protective relay having a normally open second pair of contacts, one contact of said relay second contact pair being connected from said run contact; said combination including an audible alarm connected from the other contact of said relay contact pair; said combination also including a red warning lamp connected from said other contact of said relay second contact pair.

* * * * *